US005341549A

United States Patent [19]

Wirtz et al.

[11] Patent Number: 5,341,549

[45] Date of Patent: Aug. 30, 1994

[54] APPARATUS FOR REMOVING YARN REMNANTS

[75] Inventors: Ulrich Wirtz; Hans Grecksch; Wolfgang Irmen; Helmuth Hensen; Walter Böhmer, all of Mönchenglabach, Fed. Rep. of Germany

[73] Assignee: W. Schlafhorst AG & Co., Moenchengladbach, Fed. Rep. of Germany

[21] Appl. No.: 949,684

[22] Filed: Sep. 23, 1992

[30] Foreign Application Priority Data

Sep. 23, 1991 [DE] Fed. Rep. of Germany ..... 4131667

[51] Int. Cl.[5] ..... B65H 73/00

[52] U.S. Cl. ..... 28/298; 28/295; 28/292; 28/297

[58] Field of Search ..... 28/298, 297, 295, 296, 28/292, 293, 294; 139/244

[56] References Cited

U.S. PATENT DOCUMENTS

| | | | |
|---|---|---|---|
| 1,144,006 | 6/1915 | Smart et al. | 28/298 |
| 1,447,272 | 3/1923 | Stone | 28/298 |
| 1,666,735 | 4/1928 | Colman | 28/298 |
| 3,095,631 | 7/1963 | Röhl | 28/298 |
| 3,833,974 | 9/1974 | Girard | 28/297 |
| 3,864,796 | 2/1975 | Risi et al. | 28/298 |
| 3,906,598 | 9/1975 | Hacker | 28/297 |

FOREIGN PATENT DOCUMENTS 64-28180 1/1989 Japan .

*Primary Examiner*—Clifford D. Crowder
*Assistant Examiner*—Bibhu Mohanty
*Attorney, Agent, or Firm*—Herbert L. Lerner; Laurence A. Greenberg

[57] ABSTRACT

An apparatus for removing yarn remnants from a cop tube, especially a cop tube located a caddy, includes a device for removing yarn remnants from the cop tube. An elastically deformable energy storing device is disposed in the vicinity of the bottom of the cop tube. A holder for the yarn remnant removing device is movable along the cop tube and toward the energy storing device for storing potential energy.

22 Claims, 4 Drawing Sheets

APPARATUS FOR REMOVING YARN REMNANTS

SPECIFICATION

Figure 1:
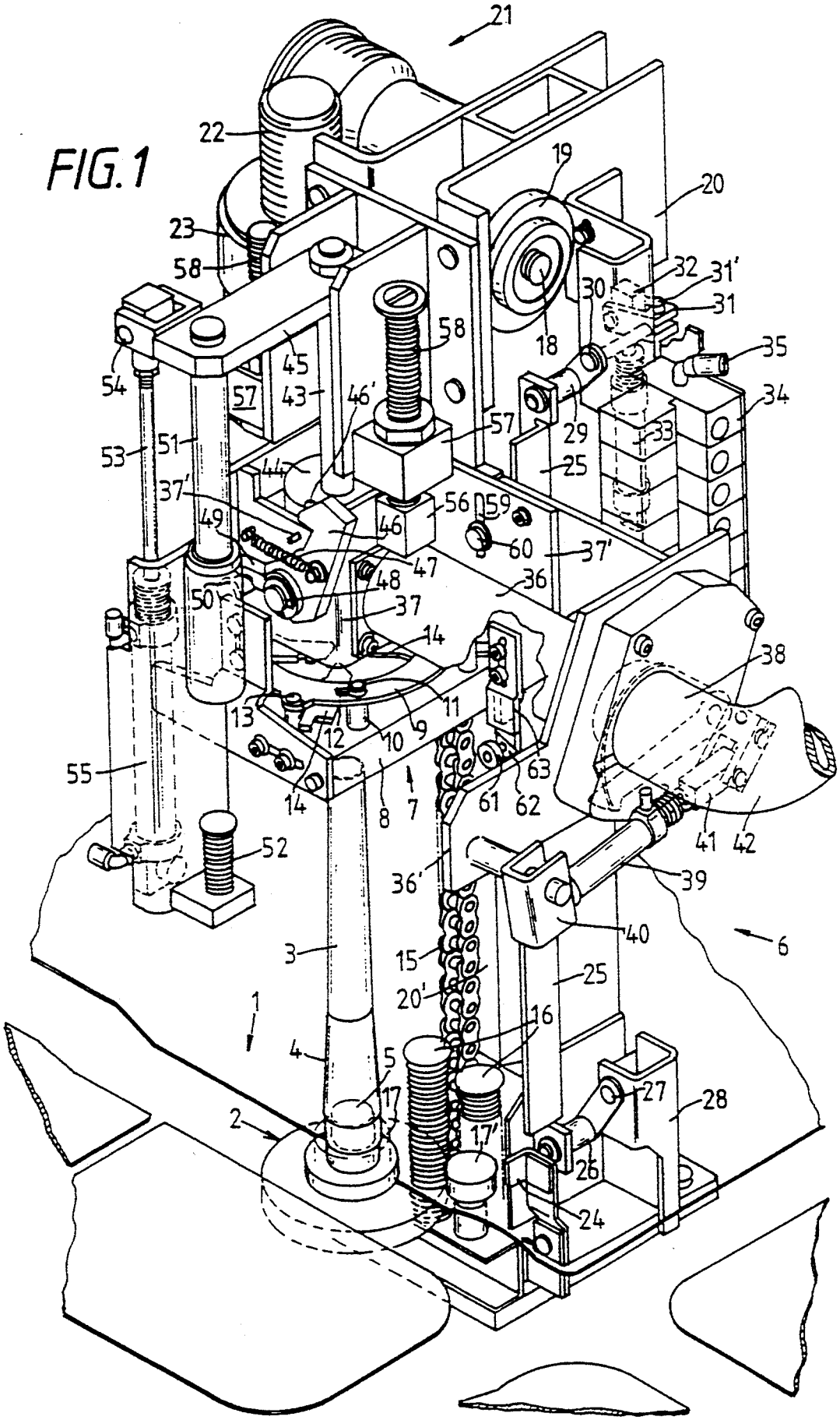

The invention relates to an apparatus for removing yarn remnants from a cop tube, in particular a cop tube located on a caddy, including a holder which holds means for removing the yarn remnants and which is movable along the cop tube.

Apparatuses for removing yarn remnants from textile bobbins, and in particular from cops, have been known for a long time. In bobbins that have only a slight yarn remnant which is unsuitable for further processing, the necessity arises of removing the yarn remnant, because it would be in the way upon rewinding. The most varied kinds of apparatus have been disclosed for such a purpose. Either they unwind the yarn by rotating the bobbin or by using suction, or they sever the yarn strand and remove it by suction, or they pull the yarn strand downward together with a tube suspended in a holder. In bobbin winding machines that have transport systems with circulating caddies located on conveyor belts and guided by guide channels, with each caddy having a cop or a cop tube on a mounting mandrel, it is practical for the caddy with the cop tube carrying the yarn remnant to be delivered to a suitable tube cleaner and for the yarn remnant to be removed while the tube is still on the caddy.

One such apparatus is described in Published Japanese Application No. 64-28180. In that apparatus, a holder for the means for removing the yarn remnants is movable along the cop tube. A holding-down device for the cop tube is also provided, in order to enable counteracting an upwardly exerted force upon removal of the yarn remnant in such a way that the tube remains on the mandrel of the caddy. The reciprocating motion of the holder in that known apparatus is generated by means of a driven threaded spindle.

In order to remove the yarn remnant, a pin is thrust underneath the yarn remnant lap or winding from below, to enable lifting of the lap from the tube surface far enough to permit a cutting knife to sever the yarn layers without touching the surface of the tube. A relatively great force must be generated for the vertical motion of the holder, in order to drive the lifting pin under the lap. At the same time, the upwardly oriented vertical motion must proceed very slowly. In order to achieve such a goal, the threaded spindle must have only a very slight inclination. However, that means that the speed of motion as the holder is moved into its lowermost position is likewise low. That considerably increases the cycling time for cleaning yarn remnants from the cop tubes. On the other hand, if the motor for driving the threaded spindle is operated at its rated rpm in order to generate an adequately high speed of motion only upon downward transport of the holder, then the motor would have to be operated far below its rated rpm for the upward motion of the holder, which as already noted must proceed substantially more slowly. That necessarily means that the motor remains markedly below its rated capacity. In that case, the necessary force for lifting the yarn remnant lap or winding could not be brought to bear.

It is accordingly an object of the invention to provide an apparatus for removing yarn remnants, which overcomes the hereinafore-mentioned disadvantages of the heretofore-known devices of this general type and which uses simple means to generate both the great force associated with a low speed of motion of a holder carrying the means for removing the yarn remnants in order to detach the yarn remnant lap, and a high speed of motion of the holder which shortens the cycling time.

With the foregoing and other objects in view there is provided, in accordance with the invention, an apparatus for removing yarn remnants from a cop tube, in particular a cop tube located on a caddy, comprising means for removing yarn remnants from a cop tube; elastically deformable energy storing means disposed in the vicinity of the bottom of the cop tube; and a holder for the yarn remnant removing means being movable along the cop tube and toward the energy storing means for storing potential energy.

The apparatus according to the invention uses the downward motion of the holder, which is basically carried out at zero load, for the means for removing the yarn remnants, in order to store energy for the onset of the slower upward motion. Considering the entire reciprocating motion of the holder, it is precisely in this starting phase that by far the greatest force must be brought to bear. In this starting phase, the energy of the energy storage means is available in addition to the driving energy of the motor. Accordingly, it need not be additionally brought to bear by the motor itself. The motor can therefore be operated markedly below its rated rpm in this phase, because the attendant absent power is still balanced out or even exceeded by the energy storage means. The markedly higher rated rpm can accordingly be utilized for the downward motion. The downward motion can proceed very quickly as a result and leads to shortening the cycling time for cleaning a cop tube of its yarn remnants.

In accordance with another feature of the invention, there are provided longitudinal guides guiding the holder, and at least one bidirectionally drivable traction means from which the holder is suspended.

As compared with driving the holder by a threaded spindle, driving it through traction means is both less expensive and above all less vulnerable to malfunction. Unless a threaded spindle is additionally encapsulated, which is complicated and expensive, yarn material in the textile machine can easily get into the threads of the threaded spindle. Even a small amount of such contaminants can render the drive inoperable.

By comparison, a chain drive, for example, is relatively invulnerable to malfunction. Therefore, in accordance with still an additional feature of the invention, the traction means are a chain.

In accordance with a further feature of the invention, there is provided a drive for the traction means having a self-locking worm drive.

The use of a self-locking worm drive, which is disposed in a housing that is typical for such a mechanism, makes it readily possible to establish a suitably high gear ratio between the motor and the chain drive, and the holder can be stopped in arbitrary vertical positions without additional braking means.

In accordance with an added feature of the invention, the drive has a pole wheel, an incremental counter, and a calibration marking for the incremental counter being disposed along a stroke path of the holder, for exact and arbitrary positioning.

Using a pole wheel with an incremental counter makes virtually any vertical position of the holder definable and approachable. Through the use of a calibration marking, which is advantageously disposed at bottom dead center of the holder, calibration of the incremental counter can be performed upon each double stroke. This permits very exact positioning.

In accordance with an additional feature of the invention, the energy storing means are compression springs.

In the simplest case, compression springs, which are compressed by the holder during its downward travel, can be used as energy storing means. The potential energy of these compression springs is then fully available upon starting of the holder in the direction for removal of the yarn remnant lap or winding. At the same time, the compression springs brake the holder in its last motion phase in the relatively rapid downward travel. In this way, the kinetic energy released upon braking can still be utilized directly.

In accordance with yet another feature of the invention, the yarn remnant removing means include at least three stripper elements for stripping off over the tip of the cop tube.

In accordance with yet a further feature of the invention, there are provided springs, the stripper elements being concentrically disposed on the holder and pivotable outward counter to the force of the springs.

The use of stripper elements disposed concentrically on the holder to remove the yarn remnant lap is simple and not very time-consuming, as compared with the known apparatus that cuts the lap apart by means of a severing disk. Since the stripper elements can be placed against the tube surface or against the lap by spring force, there is also no danger of exerting an excessive pressing force on them, which could possibly cause damage to the surface of the cop tube. A further advantage is that in this way tubes of different diameter can be cleaned without requiring adjustment of the stripper elements. Nor does the disposition of at least three stripper elements require that their front edge, which comes into contact with the tube or the package, be adapted to the radius of curvature of the tube, because three engagement points already assure secure grasping of the yarn remnant lap or winding.

In accordance with yet an added feature of the invention, there is provided a common coupler for actuating the stripper elements, and an actuation device for the coupler for actuating the stripper elements at arbitrary vertical positions of the holder including a control element extending over an entire stroke path of the holder.

The specific control of the stripper elements by a common coupler, through a control element extending over the entire stroke path of the holder, makes it possible to actuate the stripper elements completely independently of the vertical position of the holder. For instance, once the holder has reached the height of the cop travel in its downward motion, this makes it possible to close the stripper elements, as a result of which these elements pre-center the tube. This can be significant especially with relatively long tubes, because even a slight skewing of the caddy on its base will already cause a marked deviation in the position of the tube tip.

In accordance with still another feature of the invention, the control element is a control rail extending parallel to the longitudinal axis of the cop tube, and including parallel steering arms for moving the control rail parallel to the longitudinal axis of the cop tube, and means for placing the control rail in continuous contact with the common coupler along a stroke path of the carriage.

In accordance with still a further feature of the invention, the springs acting upon the stripper elements force the common coupler to come to a stop against the control rail.

In accordance with yet an additional feature of the invention, there is provided a centering and holding mandrel for centering and holding the cop tube, and a suction housing in which the centering and holding mandrel is longitudinally displaceably disposed.

A centering and holding mandrel that is inserted into the tube from above to center and hold it could very severely damage the tube unless the tube is adequately centered.

Inserting the centering and holding mandrel into the tube tip is advantageously carried out when the tube is still being held in centered fashion by the stripper elements disposed in the vicinity of the tube tip. In this way, damage to the tube tip can be very effectively avoided.

As compared with a centering bell of the kind used in Published Japanese Application 64-28180, for instance, the exclusive use of a centering and holding mandrel offers the advantage of permitting the yarn remnant lap to be pushed right onto this centering and holding mandrel, which has a diameter that should be slightly less than the tube diameter, without a centering bell, which would surround the tube, being capable of impeding this process. A further advantage is that even upon lowering of the centering bell, when the edge of the tube tip slides along the conical inside surface of the centering bell, it could be damaged.

A further advantage, resulting from the independence of the reciprocal motion of the holder and the triggering of the stripper elements, is that after a brief stroke phase for loosening the yarn remnant lap, the stripper elements can be reopened and the holder can be driven back into its lower position, retensing the compression springs, and the stripper elements in their lowermost position can grasp the yarn remnant lap once again. The result is a cleaning repetition function, which makes it possible to strip off even relatively large yarn remnant laps, which cannot be cleaned with known equipment. Nor do such solid laps allow the entry of a lifting pin between the tube surface and the lap or winding in order to lift the lap so that it can be severed by a severing disk.

In accordance with again another feature of the invention, there are provided means for locking the centering and holding mandrel in a lowermost position in which the centering and holding mandrel centers the cop tube.

The provision of a lock for the centering and holding mandrel in its lowermost position makes it possible to absorb the relatively major shear force created upon unwinding of the yarn remnant lap.

In accordance with again a further feature of the invention, there is provided a ram connected to the centering and holding mandrel, and elastically deformable energy storing means toward which the ram is movable for storing potential energy.

In accordance with still an added feature of the invention, there are provided actuating means being disposed on the holder and being operative upon upward motion of the holder for releasing the locking means for the centering and holding mandrel.

Therefore, a ram connected to the centering and holding mandrel is also moved in this position against an energy storing means, which are advantageously once again a compression spring. The locking also serves to absorb that spring force. After the yarn remnant lap has been stripped onto the centering and holding mandrel, the spring force can become operative immediately upon release of the locking, and a rapid start of the centering and holding mandrel can be assured. As a result, rapid stripping off of the yarn remnant lap from the upwardly moving centering and holding mandrel can be performed by means of fixedly disposed stripping means, with simultaneous removal by suction of the yarn remnant by means of a suction channel discharging into the suction housing surrounding the centering and holding mandrel. Therefore, in accordance with again an added feature of the invention, there is provided a closable suction connection for the suction housing.

The consumption of vacuum intake air is minimized by the closeability of the suction connection for the suction housing.

In accordance with again an additional feature of the invention, there is provided a suction path leading away from the suction housing, and a pair of strand-cutting scissors disposed in the suction path for severing a yarn strand not completely severed from the cop tube.

In the event that the yarn remnant lap in the form of a hank or strand is still joined to the cop tube once the unwinding process per se has been completed, then a pair of strand-cutting scissors assures the severing of this strand. Even if the incomplete removal of the yarn remnant lap or winding is the exception, if the strand-cutting scissors were not provided the result would be blockage of the entire transport part, since the caddy with the tube having the yarn remnant strand would be unable to leave the tube cleaning apparatus.

In accordance with still another feature of the invention, there are provided means, such as a circuit or indexing means, for placing the stripper elements against the cop tube in the vicinity of a tip of the cop tube for pre-centering the cop tube.

In accordance with still a further feature of the invention, the yarn remnant removing means include at least three stripper elements for stripping off over the tip of the cop tube, and the means, such as a circuit or indexing means, for placing the stripper elements against the cop tube trigger the pre-centering of the cop tube before the centering and holding mandrel reaches the tip of the cop tube.

In accordance with still an added feature of the invention, there are provided means, such as a circuit or indexing means, for repeating a stroke of the holder in the vicinity of a yarn remnant lap.

In accordance with a concomitant stripper means disposed in the suction housing for stripping off a yarn strand from the centering and holding mandrel.

Other features which are considered as characteristic for the invention are set forth in the appended claims.

Although the invention is illustrated and described herein as embodied in an apparatus for removing yarn remnants, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1A:
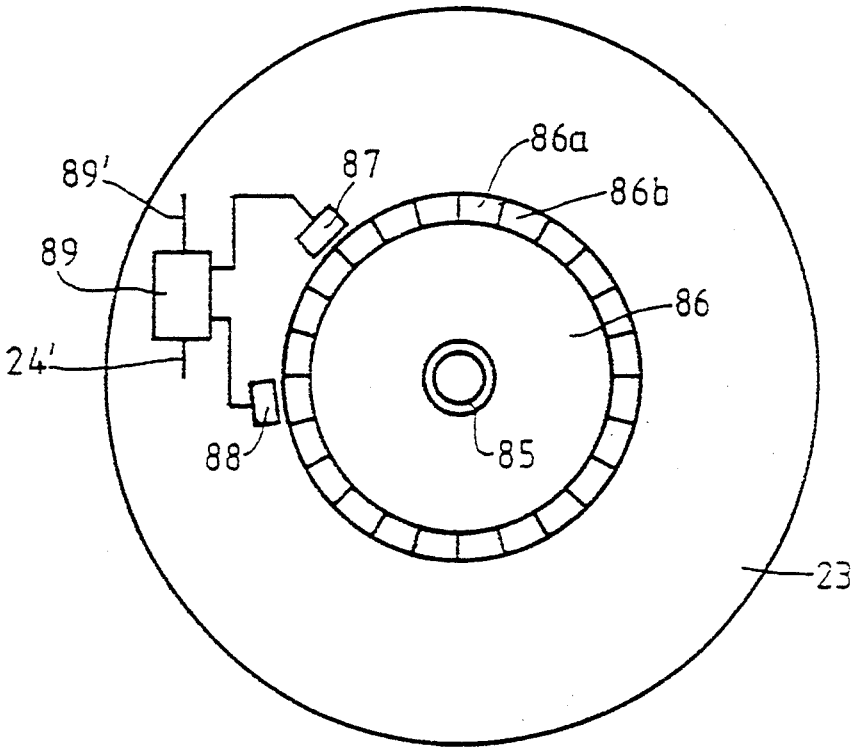

FIG. 1 is a fragmentary, diagrammatic, partly broken-away perspective view of an entire apparatus according to the invention;

FIG. 1*a* is a view of a pose disk and associated Hall sensors.

Figure 2:
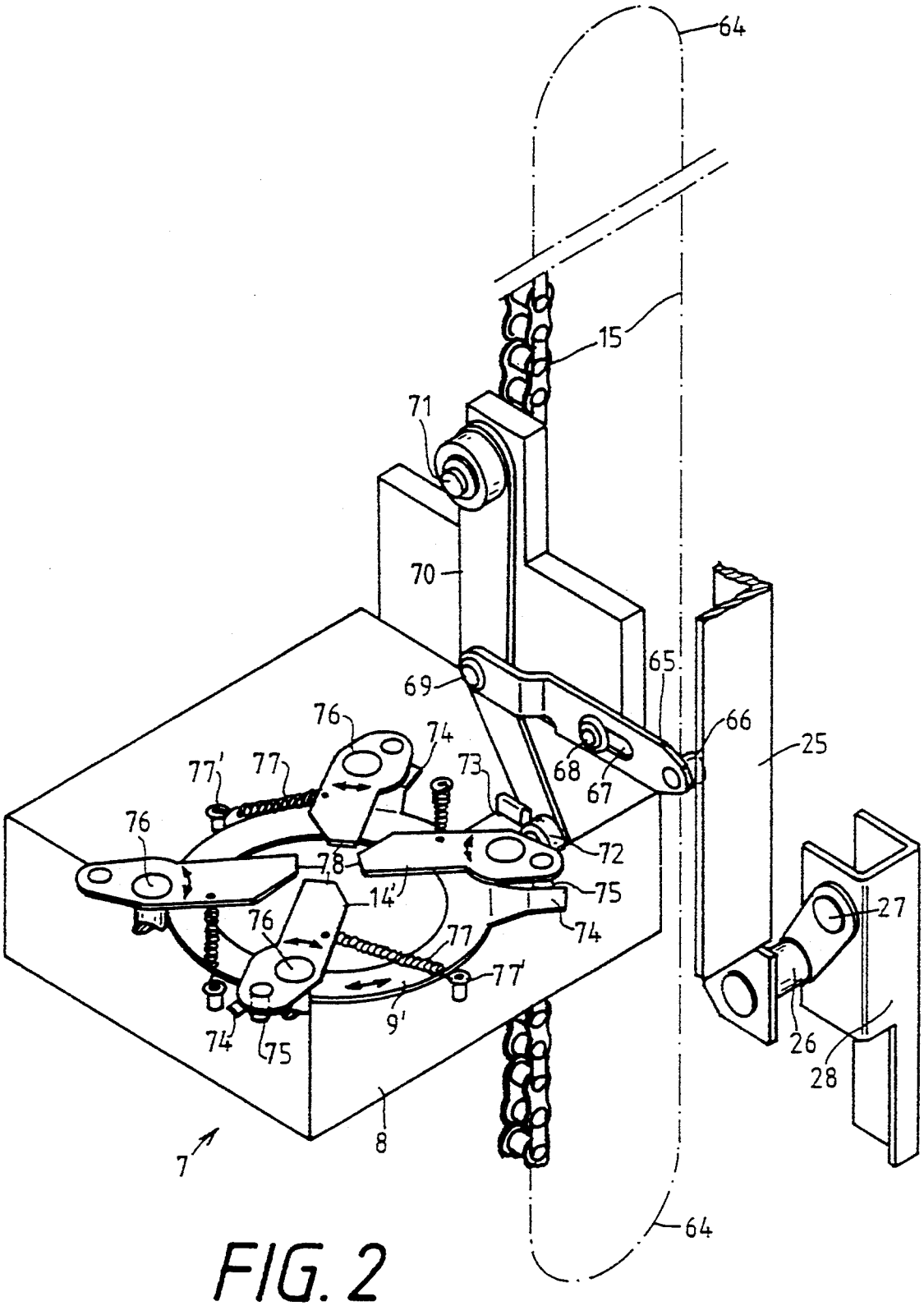
Figure 3:
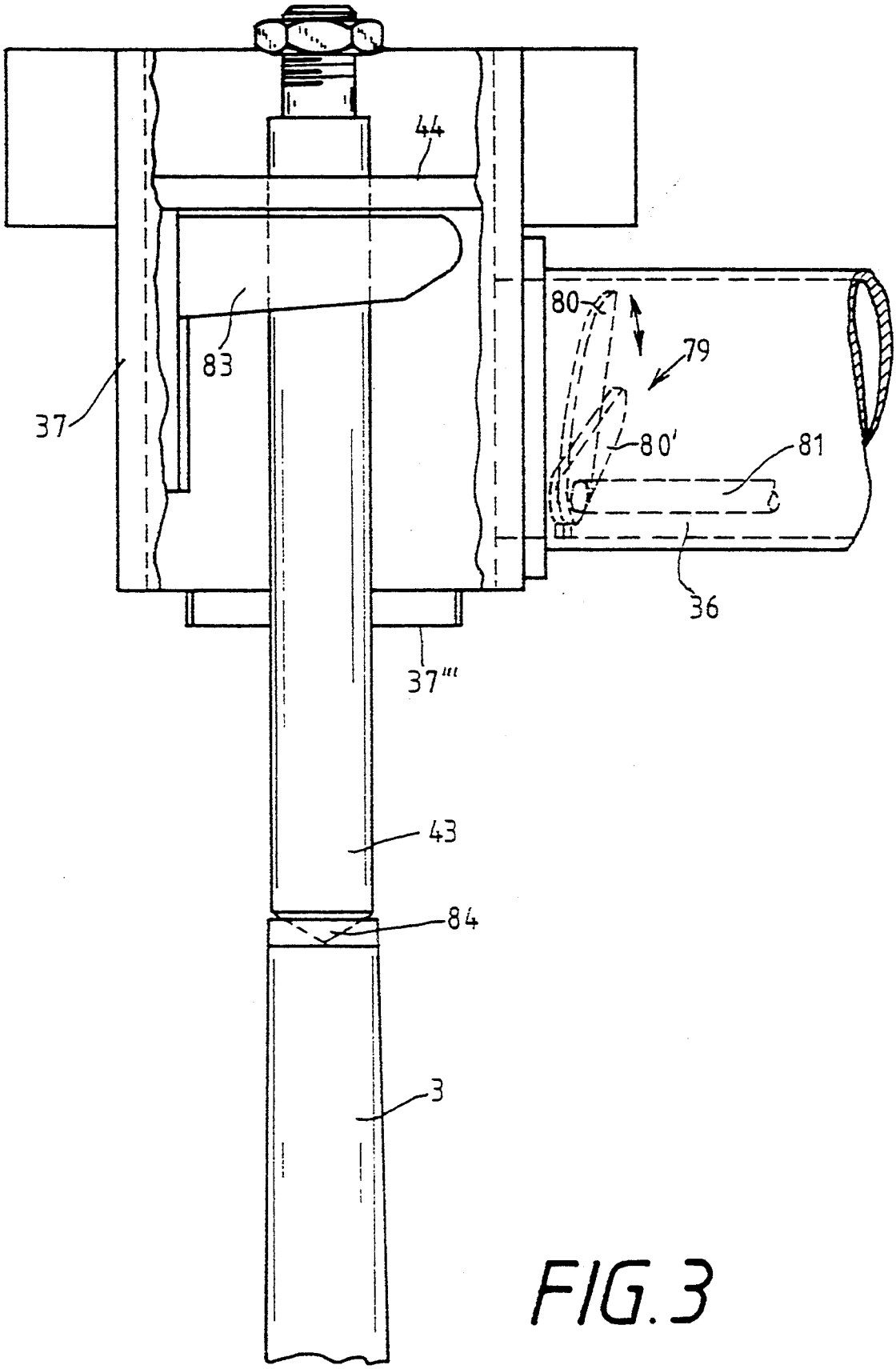

FIG. 2 is a fragmentary perspective view of a holder for stripper elements with an associated actuating device; and FIG. 3 is a fragmentary, partly broken-away side-elevational view of a suction housing with a centering and holding mandrel, a stripper fork and strand-cutting scissors.

Referring now to the figures of the drawing in detail and first, particularly, to FIG. 1 thereof, there is seen a tube cleaning apparatus 6 that is disposed along a transport path 1, along which caddies 2, with tubes 3 mounted on mounting mandrels 5 thereof, can be transported. Further details regarding the transport path, such as a conveyor belt on which the caddies 2 rest, and an optionally present waiting row of caddies 2 upstream of the tube cleaning apparatus 6, have been omitted for the sake of simplicity. A stopper configuration for the caddies 2 in the tube cleaning apparatus 6 includes an electromagnet 17 and a stop 17'. In order to provide for this eventuality, the base plate of the caddy 2 carries an encompassing iron ring, by which the caddy is held firmly to the electromagnet. Since the non-illustrated conveyor belt on which the caddy 2 stands is typically driven continuously, the stop 17' is additional security for preventing the further transport of the caddy 2 onward, counter to the force of the electromagnet 1.

The tube 3 mounted on the mounting mandrel 5 of the caddy 2 has a yarn remnant lap or winding 4 which is to be removed in the yarn cleaning apparatus 6. To that end, the yarn cleaning apparatus 6 has a carriage 7 with a frame 8 that simultaneously forms a holder for stripper jaws 14. As is shown even more clearly in FIG. 2, this carriage 7 is mounted on a roller chain 15. Deflection points 64 that are shown in FIG. 2 are constructed as sprocket wheels, which are covered by corresponding parts of a machine frame 20 or by a bearing 19 in FIG. 1. Since the reflection points 64 are conventional sprocket wheels, around which the chain 15 is wrapped as an endless chain, no attempt was made to provide a more detailed view. However, it can be seen that a drive shaft 18 of the upper sprocket wheel is connected to a drive 21. This drive 21 has a worm drive 22 that is connected to a motor 23.

The worm drive 22 is a known self-locking worm drive. Therefore, the motor 23 is stopped rapidly without additional braking means after being turned off. Moreover, the carriage 7 is securely held in any vertical position by this drive, once again without braking means.

The worm drive 22 is accommodated in a mass-produced transmission housing and is therefore not under the influence of contaminants in the region of the bobbin winding machine. This makes it possible, at practically no additional expense, to avoid interfering factors of this kind.

A pole wheel may be disposed on the shaft of the motor 23 and one or two Hall sensors that cooperate with an incremental counter may be disposed opposite it. As a result, engine revolutions can be monitored to an accuracy of fractions of one revolution. Due to the form-locking transmission of the engine revolutions to the carriage 7, the motion of the carriage is accordingly monitorable as well. A form-locking connection is one which connects two elements together due to the shape of the elements themselves, as opposed to a force-locking connection, which locks the elements together by force external to the elements. By calibrating the incremental counter with reference to a predetermined position of the carriage 7, the vertical position of the carriage can be monitored and controlled continuously. In order to provide calibration, a sensor 24 is disposed at bottom dead center of the reciprocation or stroke path of the carriage 7. Upon each double stroke of the carriage 7, the sensor sets-in the incremental counter to zero and thus calibrates it. The carriage 7 can thus be triggered practically in such a way that it can be stopped at any arbitrary position along its stroke path and restarted in an arbitrary direction without loss of the knowledge of its position.

A disposition of a pole disk and Hall sensors as transducers for an incremental counter is illustrated in FIG. 1*a*. A position sensor of that kind is described in German Published, Non-Prosecuted Application DE 40 25 003.2 A1, for instance.

With reference to FIG. 1*a*, a pole wheel 86 is disposed on the shaft 85 of the motor 23, opposite from the worm drive 22. The pole wheel 86 carries on its periphery magnet segments 86*a* and 86*b* with alternating polarity. Adjacent the outer periphery of the pole wheel 86 there are disposed two Hall sensors 87 and 88 in such a way that their mutual spacing along the peripheral line is different from the division in the pole segments.

Two pole segments 86*a* and 86*b* are disposed opposite the Hall sensor 87 in the instant shown in FIG. 1*a*, while the Hall sensor 88 faces only one pole segment. This improves the division accuracy and reading accuracy with regard to the position of the pole wheel 86 as compared to the utilization of only one Hall sensor. It must be noted in this context, however, that the disposition of a single Hall sensor provides for satisfactory accuracy.

The two Hall sensors 87 and 88 are connected through respective lines with a counter unit 89, which counts the increments during the rotation of the pole wheel 86. The count is forwarded through a line 89' for evaluation. The connecting line 24' connects the incremental counter 89 to the sensor 24 which, as explained, resets the incremental counter 89 to zero. In other words, the incremental counter 89 is calibrated by the sensor 24 through the connection 24'.

Referring again to FIG. 1, two compression springs 16 are shown next to the bottom of the cop tube 3. At the end of its downward motion, the carriage 7 is moved toward these compression springs 16 and tenses them, by utilizing its still-existing kinetic energy as well. From this bottom dead center point, the carriage 7 then starts again, stripping off the yarn remnant lap or winding 4 as it moves upward. The stored potential energy of the compression springs 16 is utilized in this process to reinforce the force generated by the motor 23 through the chain 15. It must be recalled that it is precisely beginning at this starting point, at bottom dead center, that by far the greatest force over the entire stroke path is needed for loosening the yarn remnant lap. Since in proportion to the downward motion of the carriage 7, the carriage must be moved substantially more slowly in this phase of motion, the motor 23 cannot be operated at its rated rpm. Accordingly, the full capacity of the motor 23 is not available. However, this power difference is balanced out by the stored potential energy of the compression springs 16, and an energy excess as compared with the rated capacity is even attained. In this way, the energy necessary to loosen the yarn remnant lap can be generated by simple means.

In the exemplary embodiment, the frame 8 of the carriage 7 forms the holder for the four stripper jaws 14, which are concentrically disposed 90° apart from one another. In FIG. 1, these stripper jaws 14 are rotatably disposed below an actuating ring 9. The pivot points are located under the actuating ring 9 and therefore cannot be seen. The actuating ring 9 acts through driver pins 13 upon the rear end of the stripper jaws 14, which are constructed as two-armed levers. The actuating ring 9 is held in stay bolts 10, which are passed through oblong slots 12 in the actuating ring 9 and are secured in the vertical direction by securing rings 11. Three or four oblong slots 12, only one of which can be seen in FIG. 1, are distributed at equal intervals around the actuating ring 9. The oblong slots 12 each extend in the circumferential direction of the actuating ring 9. As a result, the actuating ring 9 is guided by the stay bolts 10 in such a way that it is rotatable about its center by an amount that corresponds to the length of the oblong slots 12.

The actuation of the stripper elements will be described below in conjunction with FIG. 2. First, it should be noted that the variant shown in FIG. 2 differs only slightly from the variant shown in FIG. 1. An actuating ring 9' has drivers 74 that act against pins 75, which in turn engage an outer end of stripper jaws 14' which are constructed as two-armed levers. The stripper jaws 14' are mounted on pivot pins 76, which in turn are supported in the frame 8.

One end of each tension spring 77 is supported on the side of a stripper jaw 14' that is opposite a pin 75, with respect to a pivot pin 76, and another end of each tension spring is held on a pin 77' mounted on the frame 8. These tension springs 77 pivot the stripper or unwinding jaws clockwise, as seen from above, around the pivot pins 76. In this process the pins 75 rest on the drivers 74 of the actuating ring 9'. The stripper jaws are opened to a variably great extent depending on the position of the actuating ring 9' (or the actuating ring 9 in FIG. 1). The opening angle of the stripper jaws determines the relative spacing of stripper edges 78.

An angle element 73, on which a roller 72 of a lever 70 rests, can be seen on the actuating ring 9' in FIG. 2. The lever 70 is rotatable about an axle bolt 71 that is secured to the carriage 7. An arm 65 is pivoted about a pivot pin 69 of this lever 70 and has a roller 66 on its opposite end.

This roller 66 rests on a control element or rail 25. By varying the horizontal position of the control rail 25, a horizontal motion can be transmitted through the roller 66 to the arm 65. In the process, this arm 65 slides with an oblong slot 67 formed therein being penetrated by a slide bolt 68, that is also secured to the carriage 7. It is therefore seen that a common coupler for actuating the stripper elements 14, 14' is provided by elements 9 or 9' and 66–73.

If the control rail 25 and thus the arm 65 are displaced toward the left as seen in FIG. 2, the lever 70 is pivoted clockwise about its pivot point. In the process, the roller 72 displaces the angle element 73 and the actuating ring 9' in a counter-clockwise direction. This motion is transmitted through the drivers 74 mounted on the actuating ring 9', to the pins 75 of the stripper jaws 14', which in turn are pivoted counter-clockwise about the pivot pins 76, counter to the force of the springs 77. In the process, the relative spacing of the stripper edges 78 increases. Thus the overall stripper configuration is open, so that a tube, or given an adequate opening angle, the package on a cop as well, can pass between the stripper jaws 78.

If the control rail 25 deflects back in the opposite direction, then due to the force of the tension springs 77 through the pins 75 and the drivers 74, the actuating ring 9' is pivoted clockwise, and the angle element 73 acts counter to the roller 72 and pivots the lever 70 counter-clockwise. As a result, the arm 65 is moved to the right in turn. In this way, even upon retraction of the control rail 25, the roller 66 remains in contact with it, with one exception to be described in detail below.

Although only a lower retainer for the control rail 25 is shown in FIG. 2 in the form of a coupler, both retainers of the control rail 25 can be seen in FIG. 1. Parallel steering arms in the form of cranks 26 and 29 form a parallel pair of steering arms, as a result of which the control rail 25 does not change its vertical position even if its horizontal position changes.

The crank 29 is connected to a shaft 30, which in turn is secured to a lever 31. The shaft 30 simultaneously forms a pivot point for one end of the lever 31. A piston 32 of a fluid cylinder 33 is pivotably connected on the other end of the lever 31. If the position of the piston 32 in the fluid cylinder 33 changes, then the shaft 30 is accordingly rotated with the crank 29. A clockwise rotary motion in terms of FIG. 1 would mean that the control rail 25 is moved toward the carriage 7. As can be seen from FIG. 2, this would lead to the opening of the stripper jaws 14', or of the stripper jaws 14 in FIG. 1.

Since the crank 26 on the lower end of the control rail 25 is disposed and dimensioned analogously to the crank 29 and is likewise rotatable about a fixed pivot point 27 on a retainer 28, this crank 26 passively executes the same rotary motion as the crank 29. Accordingly, and as already noted, these cranks act as a parallel pair of steering arms, with the result that the control rail 25 is shifted horizontally by the same amount over its entire length.

This provision can be exploited in such a way that regardless of the vertical position of the carriage 7 along its stroke path, actuation of the control rail 25 will effect the opening of the stripper jaws by the same amount. Thus the stripper jaws are actuatable at any time, and this also includes the time during the motion of the reciprocating carriage 7. Since they close by spring force, or in other words in this direction they are not actuated by form-locking, damage to the surface of cop tubes can be effectively averted. Accordingly, they can also be used for various tube diameters without additional adjustment provisions, which may be especially important if different batches are being processed on a bobbin winder and different tube diameters are also used in this process.

As can be seen from FIG. 2, if the tube diameter were larger, or in other words if the spacing among the stripper edges 78 were greater, the full retraction path of the stripper jaws 14' would not be attained, and thus the actuating ring 9' would not rotate clockwise by the full amount and finally, the arm 65 would not be displaced to the right as far as the position shown. However, since the control rail 25 would have been shifted to its right-hand extreme position, the roller 66 would not rest on this control rail. However, that would be of no significance for reliable functioning. Since the opening angle of the stripper jaws is typically set to be large enough, this angle need not be adjusted either. In any case, the possibility exists of loosening a clamping screw 31' of the lever 31, changing the clamped position of the shaft 30 in the lever 32, and adjusting the displacement path of the control rail 25 in that way.

In order to guide the carriage 7 securely and above all parallel to the longitudinal axis of the applicable cop tube along its stroke path, rim rollers 61 are mounted through retainers 62 on supports 63 of the reciprocating carriage 7. Configurations of this kind are provided on all four sides of a vertical base 20' of the machine frame 20. Unequivocal positioning of the carriage 7 along its stroke path is achieved with simple means by using the rim rollers. Since the four rim rollers are constructed identically, a separate drawing showing all four rim rollers has been dispensed with. Torsion springs that keep the rim rollers 61 pressed against the base 20' may be provided on the supports 63 for acting upon the retainers 62. This creates a resilient bearing that nevertheless provides secure guidance for the carriage 7. Optionally, the rim rollers 61 could also have a beveled running surface, and as a result the carriage 7 could always adjust itself automatically by means of the torsion springs. Two platforms 56 are secured opposite one another on a suction housing 37, although only one platform is visible in FIG. 1. Adjusting screws 58 are rotatably supported in the platforms 56. These adjusting screws 58 are guided by threaded blocks 57 that are likewise opposite them but are secured to the machine frame 20. Turning the adjusting screws 58 makes it possible to vary the position of the suction housing 37 in the machine frame 20 and to adapt to different tube lengths, for example.

The suction housing 37 communicates through a suction channel 36 with a suction connection 42, which in turn may be connected to central vacuum producing means of the bobbin winder. This suction connection 42 may be pneumatically disconnected from the suction tube 36 by means of a sealing flap 38. The sealing flap 38 is actuated through a piston 41 of a fluid cylinder 39 that is mounted on a retainer 40. The retainer 40 is secured in turn to a plate 36' that is supported by the suction tube 36. Thus the entire sealing mechanism for the vacuum intake air can be adjusted in height along with the suction housing 37. The suction connection 42 is typically made of flexible material or can be correspondingly pivoted.

In addition to the corresponding retainers having the adjusting screws 58, guides in the form of oblong slots 59 for sliding bolts 60 are provided in order to keep the entire vacuum system dimensionally stable, although only one slot 59 is again shown. While the oblong slots are disposed in metal plates 37' being connected to and bent at an angle from the suction housing, the slide bolts 60 are fixedly disposed on a part of the machine frame 20.

A centering and holding mandrel 43 is sealed off from the suction housing 37 by a sealing cuff 44. An upper end of the mandrel 43 is screwed together with a bridge 45, which is engaged through a joint 54 by a piston 53 of a fluid cylinder 55. The fluid cylinder 55 is fixedly mounted on the machine frame. Through the use of this fluid cylinder 55 acting through the piston 53 and the joint 54, the entire bridge 45 can be moved vertically with the centering and holding mandrel 43. The sealing cuff 44 and the fluid cylinder 55 simultaneously form a vertical guide for the entire system.

A ram 51 is also secured to the bridge 45, parallel to the fluid cylinder 55, and is movable in its lowermost position against a compression spring 52 that is likewise fixedly mounted on the machine frame. This compression spring 52 at the same time forms energy storing means for the start of the centering and holding mandrel 43 if the mandrel must be moved upward, after the yarn remnant lap or winding is fed onto it, to enable this yarn remnant lap to be stripped off and delivered to the suction channel or tube 36.

In order to be able to keep the centering and holding mandrel 43 stable in its lowermost centering position while the yarn remnant lap is being stripped off with the stripping jaws 14, and in addition to be able to do so counter to the force of the spring 52, a detent latch 46 is provided, which is mounted and rotatably supported on the suction housing 37 through an axle bolt 48. This detent latch 46 is engaged by a tension spring 47, which keeps the detent latch in its detent position.

In the view of FIG. 1, the centering and holding mandrel 43 with the bridge 45 and the other parts connected to it has reached its uppermost position. The carriage 7 is also disposed in its uppermost position. A bolt 50 that keeps an indexing lug 49 of the detent latch 46 raised counter to the force of the tension spring 47 is mounted on this carriage 7. A bolt 37'', which is mounted on the stationary suction housing 37, forms a further stop toward which the detent latch 46 is pulled by the spring 47 if the carriage 7 leaves its uppermost position and accordingly the indexing lug 49 of the detent latch 46 no longer rests on the bolt 50.

The detent latch 46 has an inclined surface 46', toward which the bridge 45 moves in the last phase of its downward motion.

As a result, the detent or indexing latch 46 is pivoted clockwise counter to the force of the tension spring 47, until the bridge 45 has moved past this inclined surface 46'. The tension spring 47 then pulls the detent latch 46 through the bridge 45, thereby securely locking the bridge. Once the carriage 7 has reached its top dead center position after unwinding the yarn remnant lap or winding 4, the bolt 50 actuates the indexing lug 49 of the indexing latch 46 again, thereby pivoting it clockwise far enough so that it releases the bridge 45, and the bridge can then execute its upward motion, reinforced by the compression spring 52, by actuation of the fluid cylinder 55.

The tube cleaning apparatus 6 has a control block 34, which is continuously supplied with compressed air through a compressed air connection 35. In a time sequence set by a program, this control block opens various valves, which communicate with the compressed air lines for the fluid cylinders 33, 39 and 55.

FIG. 3 shows the suction housing 37, being partially broken away. The centering and holding mandrel 43, which has a centering cone 84 on its forward end, is disposed in such a way that it is displaceable vertically in the suction housing 37. Below the sealing cuff 44 that guides the centering and holding mandrel 43, a stripper fork 83 is mounted fixedly on the suction housing 37. This stripper fork 83 fits with little tolerance over the centering and holding mandrel 43. Once the yarn remnant lap has been slipped on, the mandrel is moved vertically upward until its centering cone 84 moves into the stripper fork 83. Since the yarn remnant lap supplied to the centering and holding mandrel 43 is stripped off completely in this way, it can easily be aspirated into the suction tube 36. A pair of strand-cutting scissors 79, which have a movable scissors blade 80 and a blade 80' and are actuated through a shaft 81, are disposed at the opening of the suction tube 36. These scissors 79 are significant in the exceptional eventuality that after being stripped off the centering and holding mandrel 43, the yarn remnant lap or winding 4 still has some connection with the cop tube 3. These scissors can either be actuated in a controlled manner if a light gate is provided in order to detect a strand of yarn in the suction tube 36, or can be actuated in any case even if such a sensor is not used.

The use of the scissors prevents any strand of yarn sticking firmly to the cop tube 3 from blocking the entire transport part 1 and thus putting the tube cleaning apparatus 6 out of operation.

The course of a cleaning operation of a cop tube 3 over time will be described below:

Once the caddy 2 has been positioned at the stop 17' by the electromagnet 17, the motor 23 is put into operation, and as a result the chain 15 is moved, counter-clockwise in terms of FIG. 2. This causes the carriage 7 to leave its upper dead center position and move downward. No later than that point in time, the fluid cylinder 33 is actuated and the piston 32 is extended. This rotates the shaft 30, with the crank 29 secured thereon in a clockwise direction, causing the control rail 25 to be shifted parallel, because of its connection with the crank 26, toward the left. As a result, the angle element 73 and thus the actuating ring 9' are moved through the roller 66, the arm 65, the lever 70 and the roller 72 mounted thereon. Through the drivers 74 and the pins 75, the stripper jaws 14' are opened, which increases the mutual spacing of the stripper edges 78. Once the frame 8 has reached the position in which the stripper jaws 14 or 14' have reached the tube tip, the motor 23 is stopped and the piston 32 is moved in the opposite direction in the fluid cylinder 33. The course of motion just described then takes place in reverse order, and as a result the springs 77 close the stripper jaws again until they rest on the tube 3. If the tube 3 is not properly centered, which can happen if the caddy 2 is slightly canted or if there is an inaccurate seat on the mounting mandrel 5, then this centering is effected by the concentric disposition of the stripper jaws. At that moment, the fluid cylinder 55 is acted upon by compressed air, which drives the piston 53 downward. Through the use of the piston 53, the joint 54, the bridge 45, the centering and holding mandrel 43 and the ram 51 are also moved downward. Due to the pre-centering of the cop tube 3 by means of the stripper jaws 14 or 14', the centering and holding mandrel 43, with its centering cone 84, meets the tube tip exactly, thereby averting damage to it. In the lowermost position of the centering and holding mandrel, the detent latch 46 locks into place in the bridge 45, as already described, once the compression spring 52 has been tensed by the piston 51 as a result of the kinetic energy during braking. In this way, the cop tube 3 is fixed in such a way that it cannot change its position in the later unwinding process.

Once the centering cone 84 has moved into the cop tube 3, the configuration of the stripper jaws is open again as described, and the downward motion of the carriage continues. The carriage then moves toward the compression springs 16 until it has reached its lowermost position. At that moment, the stripper jaws 14 are closed once again and rest on the bottom of the cop tube 3, under the yarn remnant lap or winding 4. The carriage 7 is located opposite the sensor 24 at that time, as a result of which the incremental counter on the motor 23 is set to zero.

At that moment, the motor 23 can be started in the opposite direction, as a result of which the upward motion of the carriage 7 begins. The yarn remnant lap 4 must be loosened from the surface of the cop tube 3 in this starting phase, which is why the maximum shear force in the vertical direction must be brought to bear at that moment. In this starting phase, the motor 23 is reinforced by the compression spring 16. In other words, the potential energy stored in the springs 16 supplements the energy transmitted to the carriage 7 by the motor 23. In this way, even relatively large yarn remnant laps can be loosened from the surface of the cop tube 3. Especially if the laps or windings are detachable with great difficulty for the batch being processed in the bobbin winder, the control program may include additional control steps, by means of which the motor 23 can be stopped and driven back in the opposite direction again after a predetermined stroke length, until the carriage 7 has returned to its bottom dead center position. To that end, the fluid cylinder 33 is triggered as well, and as a result the stripper jaws are briefly opened again for the downward stroke until reaching bottom dead center. The rotary direction of the motor 23 is then reversed again, causing the carriage 7 to repeat its yarn remnant lap loosening function. Since the carriage is driven back under the package again, yarn layers that otherwise would extend over the entire length of the cop tube 3 if unwound in the form of a strand and would hinder complete cleaning, can also be grasped in the course of the second stroke. The yarn remnant lap carried along by the stripper jaws 14 or 14' is slipped onto the centering and holding mandrel 43 upon passage past the tube tip. In the last phase of the upward motion, the bolt 50 then abuts against the indexing lug 49 of the indexing latch 46, and as a result, while being reinforced by the compression spring 52, the upward motion of the centering and holding mandrel 43, effected by the fluid cylinder 55, is started. The centering and holding mandrel 43 in this process carries the yarn remnant lap 4 with it through an opening 37''' in the suction housing 37, until this lap is stripped off by the stripper fork 83 and removed by suction through the suction tube 36. To that end, if at all possible, no later than once the upward motion of the centering and holding mandrel 43 is begun, the fluid cylinder 39 is actuated, thereby opening the sealing flap 38 for the vacuum intake air. Some time after the centering and holding mandrel 43 reaches top dead center, the sealing flap is closed again, to keep the consumption of vacuum intake air low. However, before the sealing flap 38 is closed, the strand-cutting scissors 79 must be actuated, so that the severed end of the strand can still be removed by suction.

We claim:

1. An apparatus for removing yarn remnants from a cop tube, comprising:

means for removing yarn remnants from a cop tube;

elastically deformable energy storing means disposed in the vicinity of the bottom of the cop tube; and a holder for said yarn remnant removing means, said yarn remnant removing means being disposed on said holder and, means for moving said yarn remnant removing means together with said holder along the cop tube into engagement with said energy storing means for storing potential energy.

2. The apparatus according to claim 1, including a caddy on which the cop tube is disposed.

3. The apparatus according to claim 1, including longitudinal guides guiding said holder, and at least one bidirectionally drivable traction means from which said holder is suspended.

4. The apparatus according to claim 1, wherein said yarn remnant removing means include at least three stripper elements for stripping off over the tip of the cop tube.

5. The apparatus according to claim 4, including springs connected to said stripper elements, said stripper elements being concentrically disposed on said holder and pivotable outward counter to the force of said springs.

6. The apparatus according to claim 5, including a common coupler for actuating said stripper elements, and an actuation device for said coupler for actuating said stripper elements at arbitrary vertical positions of said holder including a control element extending over an entire stroke path of said holder.

7. The apparatus according to claim 6, wherein said control element is a control rail extending parallel to the longitudinal axis of the cop tube, and including parallel steering arms for moving said control rail parallel to the longitudinal axis of the cop tube, and means for placing said control rail in continuous contact with said common coupler along a stroke path of said carriage.

8. The apparatus according to claim 7, wherein said springs act upon said stripper elements to force said common coupler to come to a stop against said control rail.

9. The apparatus according to claim 1, wherein said energy storing means are compression springs.

10. The apparatus according to claim 3, wherein said traction means are a chain.

11. The apparatus according to claim 3, including a drive for said traction means having a self-locking worm drive.

12. The apparatus according to claim 11, wherein said drive has a pole wheel, an incremental counter, and a calibration marking for said incremental counter being disposed along a stroke path of said holder, for exact and arbitrary positioning.

13. The apparatus according to claim 1, including a centering and holding mandrel for centering and holding the cop tube, and a suction housing in which said centering and holding mandrel is longitudinally displaceably disposed.

14. The apparatus according to claim 13, including means for locking said centering and holding mandrel in a lowermost position in which said centering and holding mandrel centers the cop tube.

15. The apparatus according to claim 13, including a ram connected to said centering and holding mandrel, and elastically deformable energy storing means toward which said ram is movable for storing potential energy.

16. The apparatus according to claim 13, including actuating means being disposed on said holder and being operative upon upward motion of said holder for releasing said locking means for said centering and holding mandrel.

17. The apparatus according to claim 13, including a closable suction connection for said suction housing.

18. The apparatus according to claim 13, including a suction path leading away from said suction housing, and a pair of strand-cutting scissors disposed in said suction path for severing a yarn strand not completely severed from the cop tube.

19. The apparatus according to claim 4, including means for placing said stripper elements against the cop tube in the vicinity of a tip of the cop tube for pre-centering the cop tube.

20. The apparatus according to claim 19, wherein said yarn remnant removing means include at least three stripper elements for stripping off over the tip of the cop tube, and said means for placing said stripper elements against the cop tube trigger the pre-centering of the cop tube before said centering and holding mandrel reaches the tip of the cop tube.

21. The apparatus according to claim 1, including means for repeating a stroke of said holder in the vicinity of a yarn remnant lap.

22. The apparatus according to claim 13, including stripper means disposed in said suction housing for stripping off a yarn strand from said centering and holding mandrel.

* * * * *